US008378900B2

(12) United States Patent
Hyvönen et al.

(10) Patent No.: US 8,378,900 B2
(45) Date of Patent: Feb. 19, 2013

(54) ANTENNA ARRANGEMENT

(75) Inventors: Lassi Pentti Olavi Hyvönen, Helsinki (FI); Jussi Olavi Rahola, Espoo (FI)

(73) Assignee: Nokia Corporation, Espoo (FI)

( * ) Notice: Subject to any disclaimer, the term of this patent is extended or adjusted under 35 U.S.C. 154(b) by 319 days.

(21) Appl. No.: 12/669,329

(22) PCT Filed: Jul. 18, 2007

(86) PCT No.: PCT/IB2007/002961

§ 371 (c)(1),
(2), (4) Date: Jun. 14, 2010

(87) PCT Pub. No.: WO2009/027763

PCT Pub. Date: Mar. 5, 2009

(65) Prior Publication Data

US 2010/0245183 A1 Sep. 30, 2010

(51) Int. Cl.
*H01Q 1/24* (2006.01)
*H01Q 1/48* (2006.01)
*H01Q 9/00* (2006.01)

(52) U.S. Cl. ..... 343/702; 343/846; 343/745

(58) Field of Classification Search ..... 343/702, 343/700 MS, 846, 745, 749
See application file for complete search history.

(56) References Cited

U.S. PATENT DOCUMENTS

| | | | | |
|---|---|---|---|---|
| 6,961,022 | B1 | 11/2005 | Tay et al. | |
| 7,330,156 | B2 * | 2/2008 | Arkko et al. | 343/702 |
| 7,362,271 | B2 * | 4/2008 | Iwai et al. | 343/700 MS |
| 2004/0204006 | A1 | 10/2004 | Zhou et al. | |
| 2005/0057414 | A1 | 3/2005 | Poilasne et al. | |
| 2005/0151689 | A1 | 7/2005 | Vesterinen | |
| 2006/0145931 | A1 | 7/2006 | Ranta | |
| 2006/0170601 | A1 | 8/2006 | Fang | |

FOREIGN PATENT DOCUMENTS

| | | | |
|---|---|---|---|
| EP | 0 622 864 | A1 | 11/1994 |
| EP | 1 329 985 | A2 | 7/2003 |
| EP | 1 562 259 | A1 | 8/2005 |
| EP | 2 040 328 | A1 | 3/2009 |
| WO | WO 2006/018711 | A1 | 2/2006 |

OTHER PUBLICATIONS

Supplementary European Search Report for Application No. EP 07 82 5282 dated May 9, 2012.
International Search Report for International Application No. PCT/IB2007/002961 completed Jan. 22, 2009.
Pertti Vainikainen; Jani Ollikainen; Outi Kivekäs; Iikka Kelander; Resonator-Based Analysis of the Combination of Mobile Handset Antenna and Chassis; IEEE Transactions on Antennas and Propagation, vol. 50, No. 10, Oct. 2002; pp. 1433-1444.
Peter Lindberg; Erik Öjefors; A Bandwidth Enhancement Technique for Mobile Handset Antennas Using Wavetraps; IEEE Transactions on Antennas and Propagation, vol. 54, No. 8, Aug. 2006; pp. 2226-2233.
Office Action for European Application No. 07 825 282.2 dated Oct. 30, 2012.

* cited by examiner

*Primary Examiner* — Hoang V Nguyen
(74) *Attorney, Agent, or Firm* — Alston & Bird LLP

(57) ABSTRACT

An antenna arrangement operable at a first resonant frequency f having a corresponding resonant wavelength λ the antenna arrangement comprising: an antenna comprising a feed; a ground plane coupled to the antenna comprising a first region and a second region; and a grounded conductive structure coupled to the first region of the ground plane, wherein the second region of the ground plane is configured such that, at the first resonant frequency f the current flows predominantly in the grounded conductive structure compared to the second region of the ground plane.

19 Claims, 6 Drawing Sheets

ANTENNA ARRANGEMENT

FIELD OF THE INVENTION

Embodiments of the present invention relate to an antenna arrangement. In particular, they relate to an antenna arrangement for use in mobile cellular communications devices.

BACKGROUND TO THE INVENTION

In recent years there has been a general trend to reduce the size of electronic devices such as mobile communications devices. The functional circuitry within these devices is generally mounted on a printed wiring board (PWB). The size of the PWB is limited by the size of the device.

In electronic devices which comprise antennas the PWB is often used as the ground plane for the antenna arrangement. The ground plane and the antenna both act as resonators so that the input impedance and the radiation pattern of an antenna arrangement are defined by the distribution of current within the ground plane and the antenna element. Therefore the ground plane must be of a particular length so that it can resonate at the correct frequencies. If the ground plane becomes too short then this has adverse effects on the operation of the antenna arrangement.

For example at 900 MHz (EGSM operation) the optimal ground plane length would be between 80-120 mm. However many mobile telephones are much smaller than this and the ground plane may be as short as 40 mm which is too short to resonate at 900 MHz.

It would be desirable to provide an antenna arrangement which is operable at the lower frequencies even if the PWB is too short.

BRIEF DESCRIPTION OF THE INVENTION

According to one embodiment of the invention there is provided an antenna arrangement operable at a first resonant frequency f having a corresponding resonant wavelength λ the antenna arrangement comprising: an antenna comprising a feed; a ground plane coupled to the antenna comprising a first region and a second region; and a grounded conductive structure coupled to the first region of the ground plane, wherein the ground plane is configured such that, at the first resonant frequency f the current flows predominantly in the grounded conductive structure compared to the second region of the ground plane.

This provides the advantage that the second region of the ground plane is effectively decoupled from the antenna arrangement at the first resonant frequency f. The impedance of the second region of the ground plane is such that the antenna couples predominantly to the grounded conductive structure rather than the ground plane so that current flows predominantly in the grounded conductive structure and the grounded conductive structure acts as the resonator. As the second region of the ground plane is decoupled from the antenna arrangement the length of the ground plane does not affect the antenna arrangement so the antenna arrangement may be used in apparatus where design constraints upon components such as the PWB make the PWB unsuitable for use as a resonator for example, where the PWB is too short to act as a ground plane at the first resonant frequency f.

The electrical length of the grounded conductive structure is not restricted by the same size and design restraints as the ground plane so it can be configured to have the correct electrical length to resonate at the desired operational frequencies of the antenna arrangement. For example, the grounded conductive structure may be configured such that the electrical length of a resonating portion comprising, the antenna, the first region of the ground plane and the grounded conductive structure has an electrical length of $$\frac{n\lambda}{m}$$

where n and in are integers. In some embodiments of the invention m may be 2.

In some embodiments of the invention the second region of the ground plane may comprise a structure configured so that the grounded conductive structure has a significantly different impedance to the second region of the ground plane at the first resonant frequency f and thus the current flow in the second region of the ground plane is restricted. For example the structure may increase the impedance of the second region of the ground plane so that the impedance of the second region of the ground plane is greater than the impedance of the grounded conductive structure. The structure may be for example, slots, LC circuits, an electromagnetic band gap structure or wave traps.

In some embodiments of the invention the grounded conductive structure may comprise a tuning device. The tuning device may enable the electrical length of the grounded conductive structure to be adjusted so that the resonant portion comprising the grounded conductive structure is arranged to resonate at frequencies other than the first resonant frequency f. The tuning device may also enable the electrical length of the grounded conductive structure to be adjusted to take into account environmental effects or to be switched off if not needed.

According to another embodiment of the invention there is provided an antenna arrangement operable at a first resonant frequency f having a corresponding resonant wavelength λ the antenna arrangement comprising: an antenna comprising a feed; a ground plane coupled to the antenna comprising a first region and a second region; and a grounded conductive structure coupled to the first region of the ground plane, wherein the second region of the ground plane is configured such that at the first resonant frequency f the antenna couples predominantly to the grounded conductive structure.

According to another embodiment of the invention there is provided an antenna arrangement operable at a first resonant frequency f having a corresponding resonant wavelength λ the antenna arrangement comprising: an antenna comprising a feed; a ground plane coupled to the antenna comprising a first region and a second region; and a grounded conductive structure coupled to the first region of the ground plane, wherein the second region of the ground plane is configured to have, at the first resonant frequency f, a significantly different impedance than the impedance of the grounded conductive structure.

According to another embodiment of the invention there is provided a method comprising; providing an antenna arrangement operable at a first resonant frequency f having a corresponding resonant wavelength λ, the antenna arrangement comprising: an antenna comprising a feed; a ground plane coupled to the antenna comprising a first region and a second region; and a grounded conductive structure coupled to the first region of the ground plane; receiving, by the antenna structure, a signal at the first resonant frequency f and coupling the antenna predominantly to the grounded conductive structure.

BRIEF DESCRIPTION OF THE DRAWINGS

For a better understanding of the present invention reference will now be made by way of example only to the accompanying drawings in which.

DETAILED DESCRIPTION OF EMBODIMENTS OF THE INVENTION

Figure 1:
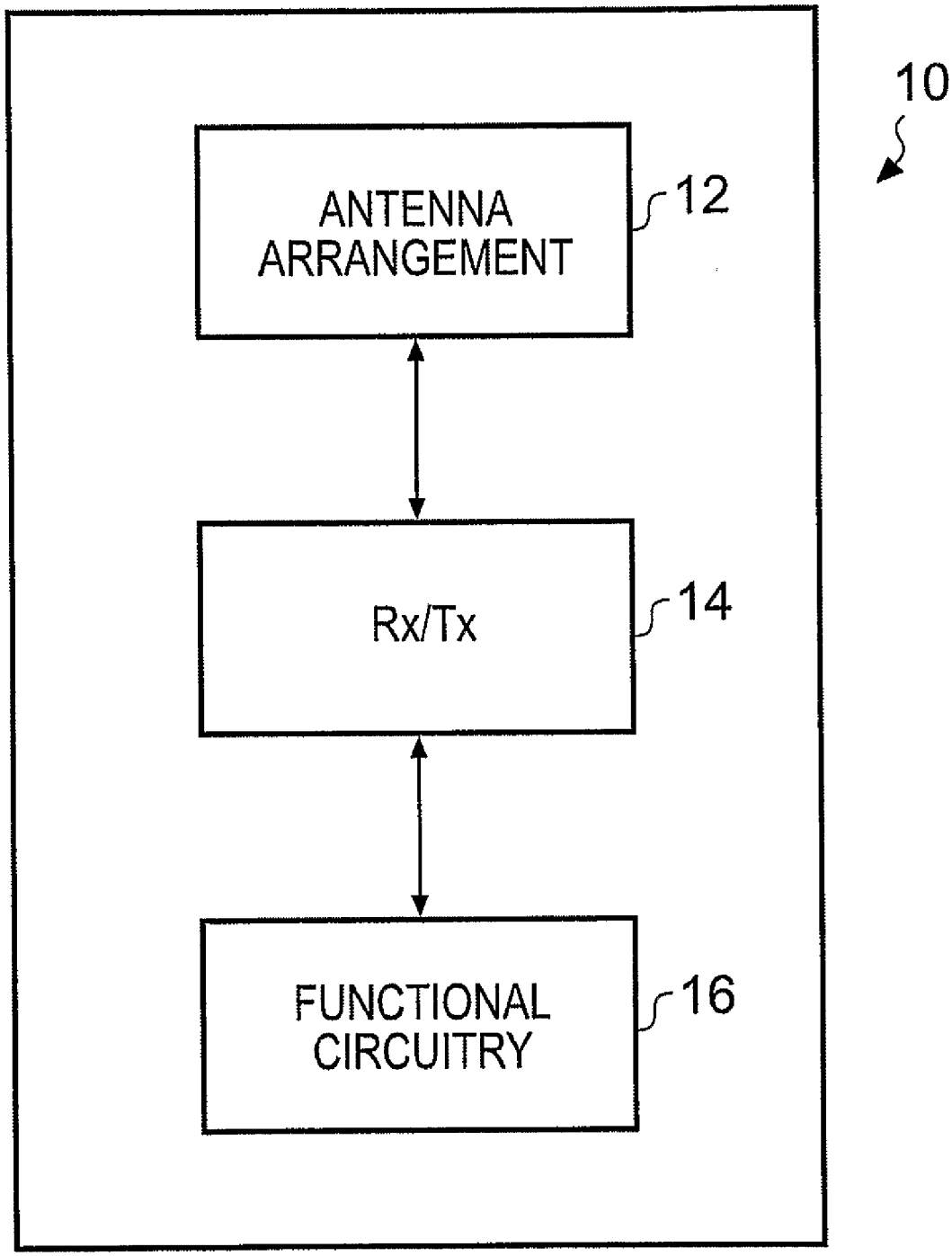
FIG. 1 schematically illustrates an electronic device including an antenna arrangement according to embodiments of the invention.

FIGS. 2 to 7 illustrate an antenna arrangement 12 operable at a first resonant frequency f having a corresponding resonant wavelength λ the antenna arrangement 12 comprising: an antenna 20 comprising a feed 22; a ground plane 24 coupled to the antenna 20 comprising a first region 28 and a second region 28; and a grounded conductive structure 26 coupled to the first region 28 of the ground plane 24, wherein the second region of the ground plane 24 is configured such that, at the first resonant frequency f, the current flows predominantly in the grounded conductive structure 26 compared to the second region 29 of the ground plane 24.

FIG. 1 schematically illustrates an apparatus 10 comprising an antenna arrangement 12 according to embodiments of the invention. The apparatus 10 may be any electronic radio communication device such as a mobile cellular telephone, a personal digital assistant (PDA) or other portable radio communication device.

The apparatus 10 comprises an antenna arrangement 12, a transceiver 14 and functional circuitry 16. In the embodiment where the apparatus 10 is a device such as a mobile cellular telephone, the functional circuitry 16 comprises a processor, a memory and input/output devices such as a microphone, a loudspeaker, a display and a user input device such as a keypad.

The transceiver 14 is connected to the functional circuitry 16 and the antenna arrangement 12. The functional circuitry 16 is arranged to provide data to the transceiver 14. The transceiver 14 is arranged to encode the data and provide it to the antenna arrangement 12 for transmission. The antenna arrangement 12 is arranged to transmit the encoded data as a radio signal.

The antenna arrangement 12 is also arranged to receive a radio signal. The antenna arrangement 12 then provides the received radio signal to the transceiver 14 which decodes the radio signal into data and provides the data to the functional circuitry 16.

The electronic components that provide the transceiver 14 and the functional circuitry 16 are interconnected via a printed wiring board (PWB). The PWB may be used as a ground plane 24 or as part of a ground plane 24 for the antenna arrangement 12.

The antenna arrangement 12 may be arranged to operate in a plurality of different operational radio frequency bands and via a plurality of different protocols. In various embodiments, the antenna arrangement 12 may include a plurality of antenna elements 20 which may operate according to different protocols (multiradio device) or the same protocol (diversity/MIMO). For example, the different frequency bands and protocols may include (but are not limited to) DVB-H 470 to 750 MHz, US-GSM 850 (824-894 MHz); EGSM 900 (880-960 MHz); GPS 1572.42 MHz, PCN/DCS1800 (1710-1880 MHz); US-WCDMA1900 (1850-1990) band; WCDMA21000 band (Tx: 1920-19801 Rx: 2110-2180); PCS1900 (1850-1990 MHz); 2.5 GHz WLAN/BT, 5 GHz WLAN, DRM (0.15-30.0 MHz), FM (76-108 MHz), AM (0.535-1.705 MHz), DVB-H [US] (1670-1675 MHz), WiMax (2300-2400 MHz, 2305-2360 MHz, 2496-2690 MHz, 3300-3400 MHz, 3400-3800 MHz, 5150-5875 MHz), RFID (LF [125-134 kHz], HF[13.56 MHz]) UHF [433 MHz, 865-956 MHz or 2.45 GHz), and UWB 3.0 to 10.6 GHz. Consequently, each of the one or more antenna elements 20 may have different electrical lengths in order to achieve these frequencies and protocols.

Figure 2:
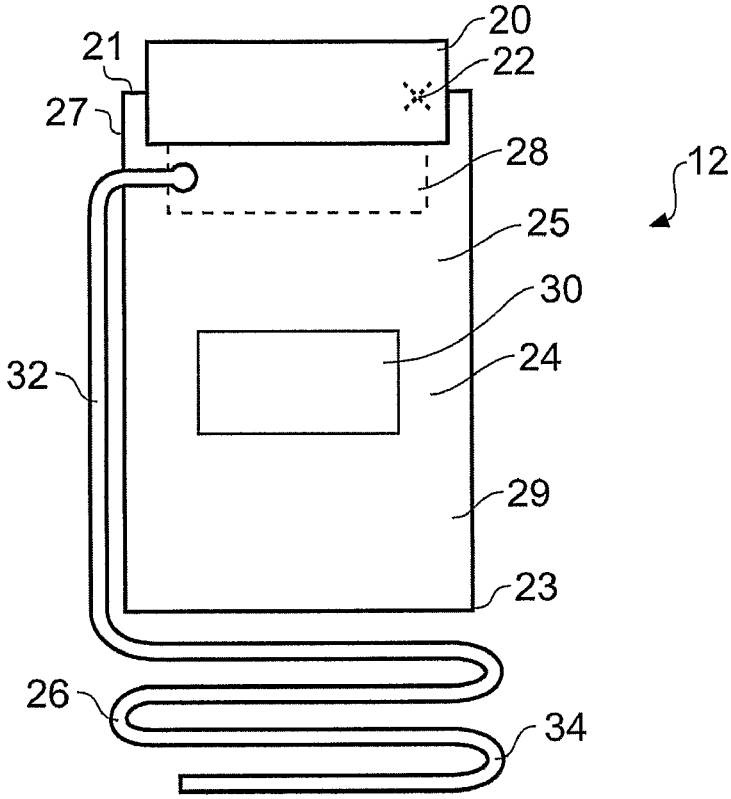
FIG. 2 illustrates an antenna arrangement according to a first embodiment of the invention.

FIG. 2 illustrates a plan view of an antenna arrangement 12 according to a first embodiment of the invention. The antenna arrangement 12 comprises an antenna 20, a ground plane 24 and a grounded conductive structure 26.

The ground plane 24 may comprise any conductive surface within the apparatus in which the antenna arrangement 12 is located. For example, the ground plane 24 may comprise a PWB, a part of the casing of the apparatus, a battery casing or an LCD display frame. In the embodiments illustrated the ground plane 24 is a PWB.

The ground plane 24 is coupled to the antenna 20. In some embodiments the ground plane 24 may be coupled to the antenna 20 via a direct connection. For example, in embodiments where the antenna is a PIFA antenna there may be a connecting portion between the antenna 20 and the ground plane 24. In other embodiments, for example embodiments where the antenna 20 is a monopole antenna, the ground plane 24 may be electromagnetically coupled to the antenna 20.

The ground plane 24 comprises a first region 28 and a second region 29. In the embodiment illustrated the ground plane 24 is rectangular so that a first edge 21 is parallel with a second edge 23 and a third edge 25 is parallel with the fourth edge 27. The first and second edge 21 and 23 are shorter than the third and fourth edge 25 and 27.

The ground plane 24 comprises transceiver circuitry 14 located in the first region 28 of the ground plane 24, close to the first edge 21. The ground plane 24 may also comprise functional circuitry 18.

The physical length of the ground plane 24 is such that it does not resonate at the first resonant frequency f of the antenna structure 12. For example, in embodiments where the apparatus 10 is a mobile telephone, the length of the ground plane 24 may be around 40 mm and the first resonant frequency f may be around 900 MHz.

The ground plane 24 also comprises a structure 30 in the second region 29 of the ground plane 24 which is configured so that the grounded conductive structure 26 has a significantly different impedance to the second region 29 of the ground plane 24 at the first resonant frequency f of the antenna arrangement 12. For example, the structure 30 may increase the impedance of the second region 29 of the ground plane 24 so that at the first resonant frequency f the second region 29 of the ground plane 24 has a higher impedance than the grounded conductive structure 26.

The antenna 20 comprises a feed 22 between the first region 28 of the ground plane 24 and the antenna 20. The feed 22 is shown in dashed lines in the figures to indicate that it is beneath the antenna 20. The feed point 22 is located close to the first edge 21 of the ground plane 24 in the region 28. The antenna 20 may be for example, a patch antenna, a PIFA antenna, A PILA antenna, a loop antenna, a whip or monopole antenna, a slot antenna, a dielectric resonator antenna, a ceramic antenna, a helical antenna or any other suitable type of antenna. In the illustrated embodiments a planar antenna such as a PIFA, PILA or patch antenna is used.

The grounded conductive structure 26 is coupled to the ground plane 24 in the first region 28 of the ground plane 24 close to the RF circuitry and the feed point 22. In the embodiment illustrated in FIG. 2 the grounded conductive structure 26 comprises a strip of conductive material which has a first portion 32 and a second portion 34. The first portion 32 extends along the fourth edge 27 of the ground plane 24 for the length of the ground plane 24 and extends past the second end 23 of the ground plane 24. The second portion 34 has a meandering structure and is positioned past the second end 23 of the ground plane 24.

The grounded conductive structure 26 may be configured so that the resonant portion comprising the antenna, the grounded conductive structure 26 and the first region 28 of the ground plane 24 has an electrical length corresponding to $$\frac{n\lambda}{2}$$

and resonates at the first resonant frequency f of the antenna arrangement 12.

The grounded conductive structure 26 may be configured to resonate together with the antenna element 20 so that the antenna element 20, the grounded conductive structure 26 and the first portion 28 of the ground plane 24 all contribute to the electrical length of the resonant portion.

The electrical length of the resonant portion comprising the grounded conductive structure 26 and the first region 28 of the ground plane 24 is the effective length of the structure and is not necessarily the same as the physical length. The electrical length may be affected by a number of factors including for example, the self inductance of the meandering portion 34, coupling between the grounded conductive structure 26 and the antenna 20 and the antenna 20 and the first region 28 of the ground plane 24 or coupling between the grounded conductive structure 26 and other components within the apparatus 10 etc. The resonant portion may comprise materials which affect the electrical length of the resonant portion. For example, where the ground plane 24 is a PWB the ground plane 24 may comprise a material which dielectrically loads the ground plane 24 at radio frequencies thereby reducing the speed of the currents within the ground plane 24 and decreasing the electrical length.

When the antenna structure 12 receives a signal at the first resonant frequency f this causes the antenna structure 12 to resonate. In the illustrated embodiment the structure 30 is configured such that the impedance of the second region 29 of the ground plane 24 at the first resonant frequency f is significantly greater than the impedance of the grounded conductive structure 26. The second region 29 of the ground plane 24 becomes electrically isolated from the antenna 20 so that the antenna 20 couples predominantly with the grounded conductive structure 26 rather than the ground plane 24 and the current flow in the grounded conductive structure 26 is much greater than the current flow in the ground plane 24. The grounded conductive structure 26, rather than the ground plane 24 acts as a resonator so that the input impedance and the radiation pattern of the antenna arrangement 12 are defined by the distribution of current within the antenna 20 and the grounded conductive structure 26.

FIGS. 3 to 7 illustrate various antenna arrangements 12 according to embodiments of the invention. In the embodiments illustrated in FIGS. 3 to 5 the antenna 20, the feed point 22 and the grounded conductive structure 26 are the same as in the first embodiment illustrated in FIG. 2. However different structures 30 are used to configure the second region 29 of the ground plane 24 to have a different impedance to the grounded conductive structure 26 at the first resonant frequency f so that current flows predominantly in the grounded conductive structure 26.

Figure 3:
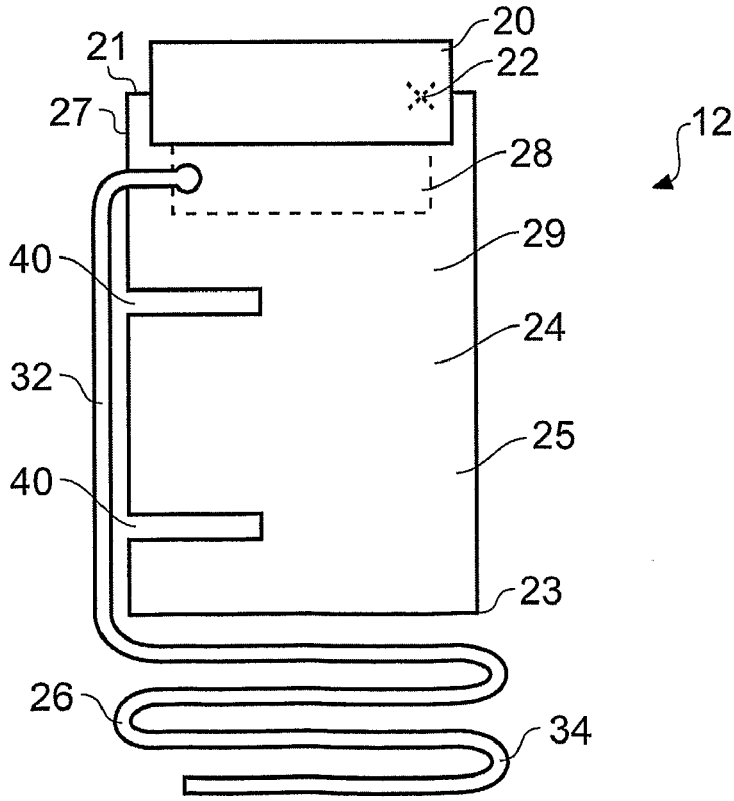
FIG. 3 illustrates an antenna arrangement according to a second embodiment of the invention.

In the second embodiment, illustrated in FIG. 3, the second region 29 of the ground plane 24 comprises two parallel slots 40 in the fourth side 27 which are configured so that the second region 29 of the ground plane 24 has a higher impedance than the grounded conductive structure 26 at the first resonant frequency f thereby decoupling the second region 29 of the ground plane 24 from the antenna 20 at that frequency. Other embodiments of the invention may use a different configuration of slots.

Figure 4:
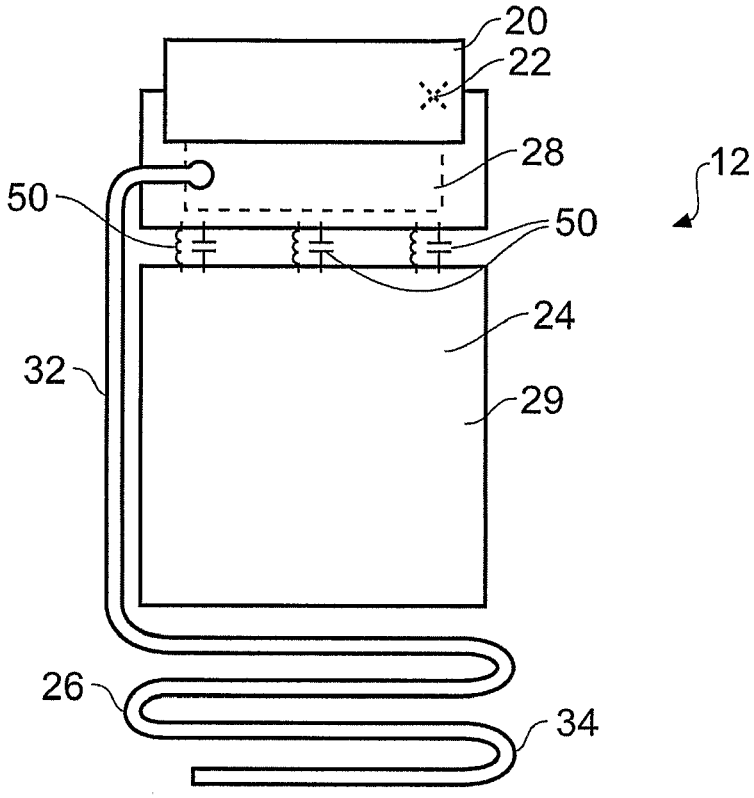
FIG. 4 illustrates an antenna arrangement according to a third embodiment of the invention.

In the third embodiment illustrated in FIG. 4 the second region 29 of the ground plane 24 comprises LC circuits 50. In this embodiment the LC circuits 50 are configured to have a high impedance at the first resonant frequency f and so that the impedance of the second region 29 of the ground plane 24 is higher than the impedance of the grounded conductive structure 26 and the ground plane 24 is effectively isolated from the antenna 20 at the first resonant frequency f. The ground plane 24 may comprise a plurality of LC circuits so that the ground plane 24 can be isolated at a plurality of resonant frequencies of the antenna arrangement 12.

Figure 5:
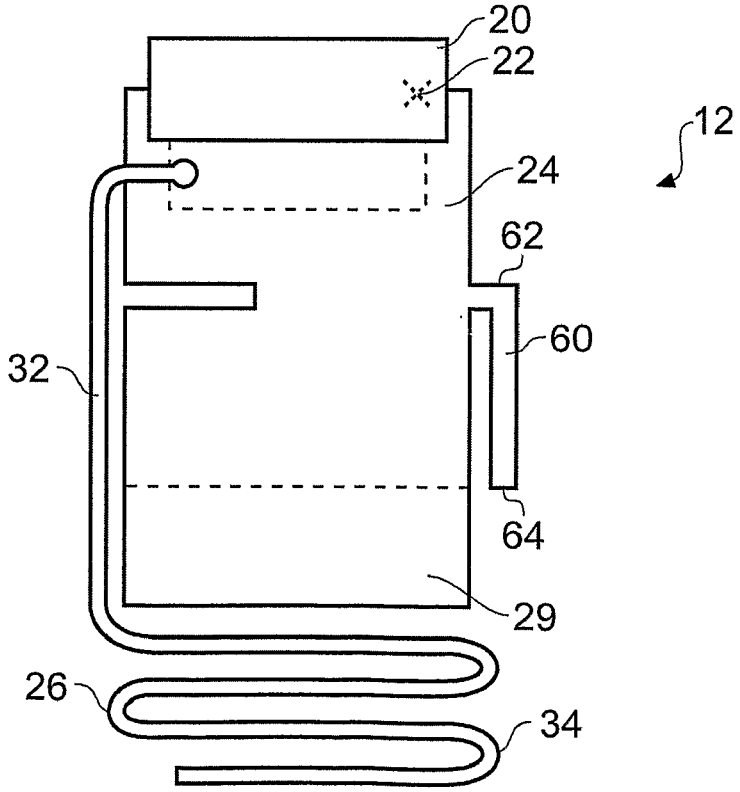
FIG. 5 illustrates an antenna arrangement according to a fourth embodiment of the invention.

In the fourth embodiment illustrated in FIG. 5 the second region 29 of the ground plane 24 comprises a wave trap 60. The wave trap 60 has a first end 62 and a second end 64. The second end 64 is an open end. The wave trap 60 acts as an open ended transmission line. The E-field in the wave trap 60 is minimum at the first end 62 and maxima at the open end 64. The wave trap 60 is matched to the ground plane 24 so that a minimum of the current in the ground plane 24 occurs parallel with the open end 64 of the wave trap 60 as illustrated by the dotted line in FIG. 5. This current minimum restricts the current flow in the second region 29 of the ground plane 24 and isolates the end of the ground plane from the rest of the antenna arrangement at the first resonant frequency f.

In another embodiment the structure 30 may be an electromagnetic band gap structure which separates the first portion 28 of the ground plane 24 from the second portion 29 of the ground plane 24. The electromagnetic band gap structure is a periodic structure comprising an electromagnetic band gap material which inhibits or reduces current flow over a certain frequency range. The structure 30 can be chosen so that the structure 30 reduces the flow of currents at the first resonant frequency f thereby isolating the second portion 29 of the ground plane 24 at that frequency. The electromagnetic band gap structure may be constructed from e.g. metal, dielectric and magnetic parts and discrete, potentially tunable electronic components.

Figure 6:
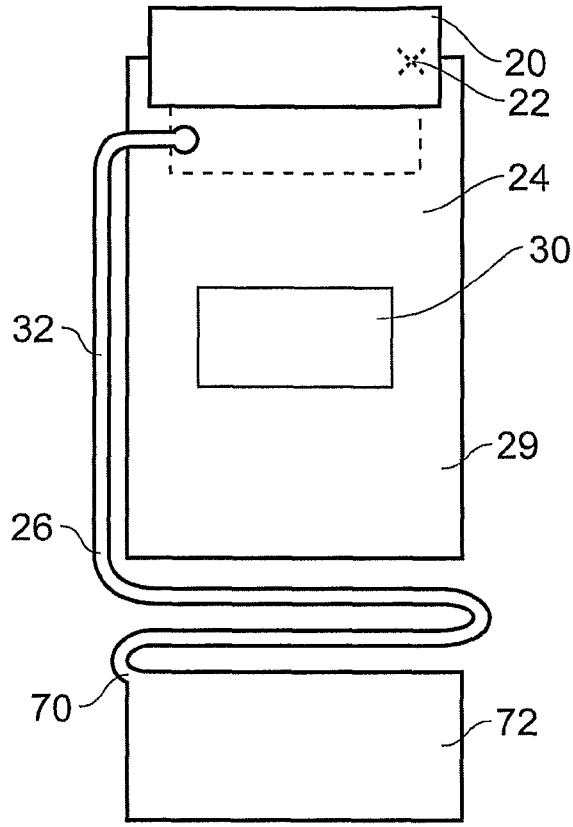
FIG. 6 illustrates an antenna arrangement according to a fifth embodiment of the invention.
Figure 7:
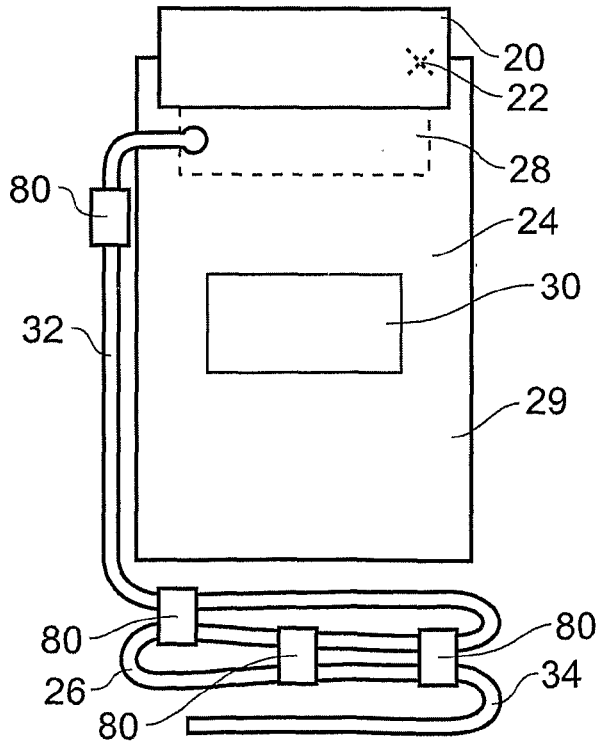
FIG. 7 illustrates an antenna arrangement according to a sixth embodiment of the invention.

In the embodiments of the invention illustrated in FIGS. 6 and 7 the antenna 20, feed 22 and ground plane 24 are as illustrated in FIG. 2 however various embodiments of the grounded conductive structure 26 are illustrated.

In FIG. 6 the grounded conductive structure 26 comprises a connection 70 to another component 72 within the apparatus 10 so that the component 70 becomes part of the grounded conductive structure 26. In the particular embodiment illustrated in FIG. 6 the component is another PWB 72. In other embodiments it could be any metal or conductive part of the apparatus 10 for example a battery casing, an LCD display frame or the casing of the apparatus 10.

The component may be configured such that the resonant portion comprising, the antenna, the grounded conductive structure 26 and the first region 28 of the ground plane 24 has an electrical length of $$\frac{n\lambda}{2}$$

and resonates at the first resonant frequency f.

In the embodiment illustrated in FIG. 7 the grounded conductive structure 26 comprises an extended portion 32 which extends along the length of the ground plane 24 and a meandering portion 34 and a plurality of tuning devices 80 situated at a plurality of locations along the grounded conductive structure 26. The tuning devices may be any suitable devices such as a switch, a variable resistor, a pin diode, a transistor, a Gallium Arsenide device (e.g. a GaAs Field Effect Transistor), a mechanical switch, a MEMs capacitor or any other suitable device.

The tuning devices enable the electric length of the grounded conductive structure 26 to be tuned so that the grounded conductive structure 26 may be operable to resonate at frequencies other than the first resonant frequency f. The tuning devices may also enable the electrical length of the grounded conductive structure 26 to be adjusted to compensate for environmental effects such as the apparatus 10 being positioned close to the head of a user. The tuning devices 80 may also enable the grounded conductive 26 structure to be switched off or disconnected from the antenna arrangement 12 when it is not needed.

Figure 8A:
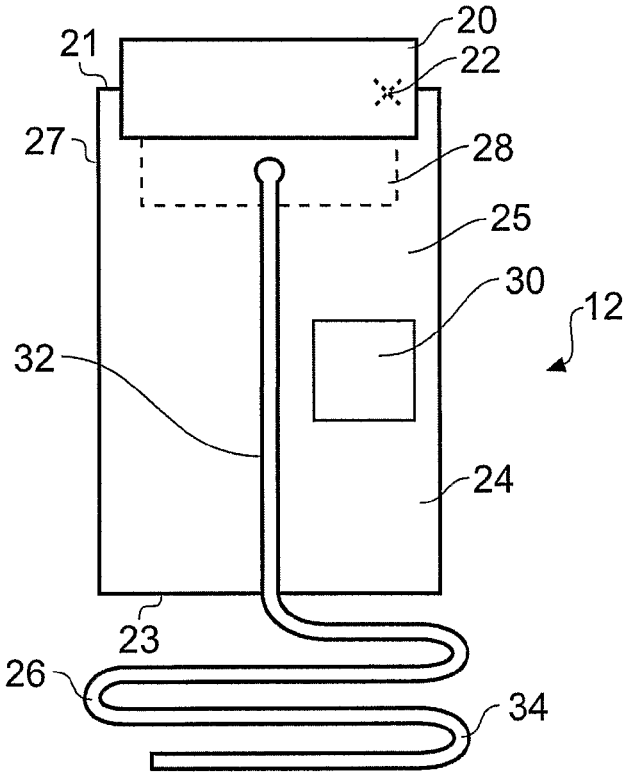
FIGS. 8A and 8B illustrate an antenna arrangement according to a seventh embodiment of the invention.
Figure 8B:
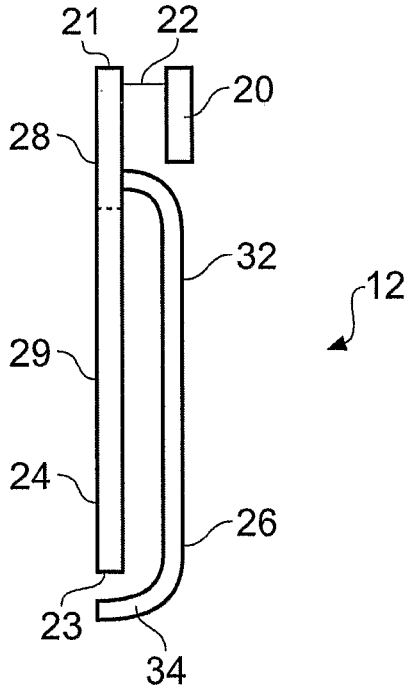

FIG. 8A illustrates a plan view of an antenna arrangement 12 and FIG. 8B illustrates a side view of the same antenna arrangement 12 in which the grounded conductive structure 26 is mounted on top of the ground plane 24 so that the extending portion 32 is in a different plane to the ground plane 24. The grounded conductive structure 26 extends over the top of the ground plane 24 rather than down the side of the ground plane 24 as in the previous embodiments. In other embodiments the grounded conductive structure 26 may be underneath the ground plane 24.

Figure 9:
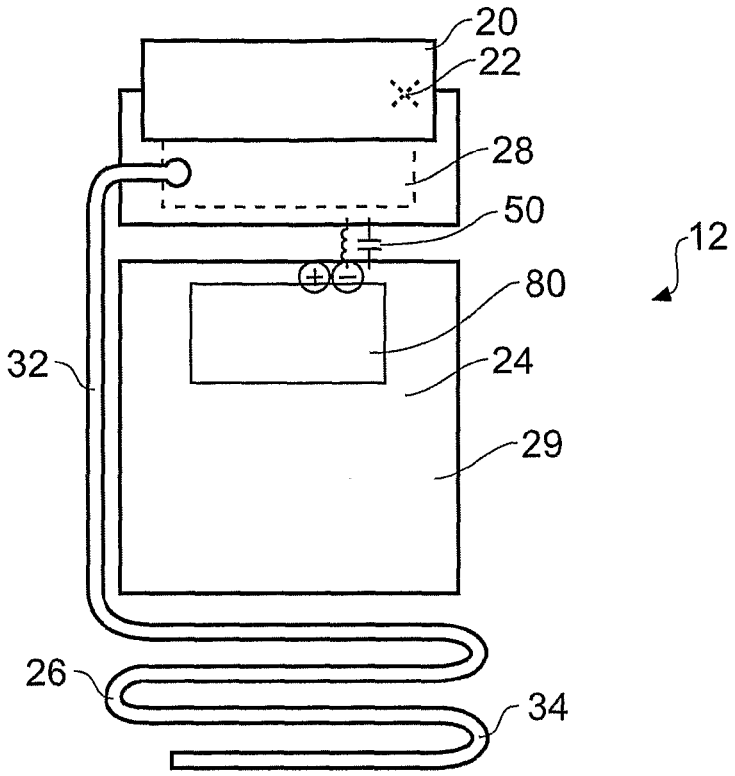
FIG. 9 illustrates an antenna arrangement according to an eighth embodiment of the invention.

In some apparatus there may be more than one component within the apparatus which may act as the ground plane 24. For example, in the embodiment illustrated in FIG. 9 the casing 80 of the battery may also act as a ground plane 24 and may also need to be isolated from the first portion 28 of the ground plane 24 and the grounded conductive structure 26. In the embodiment illustrated in FIG. 9, the first portion 28 of the ground plane 24 is separated from the second portion 29 of the ground plane 24 by an LC circuit which isolates the second portion 29 from the first portion 28 at the first resonant frequency f. The battery casing 80 is connected to the second portion 29 of the ground plane 24 so that the battery casing 80 is also isolated from the first portion 28 of the ground plane 24 by the LC circuit 50. The battery is connected to the second portion 29 of the ground plane 24 close to the connection between the first portion 28 and second portion 29 in order to avoid current loops in the ground plane 24 which may affect the current distribution in the grounded conductive structure 26.

In other embodiments the battery may be connected to the first portion 28 of the ground plane 24. In such embodiments an extra structure 30 such as a LC circuit may be required in order to electrically isolate the casing 80 of the battery from the first portion 28 of the ground plane 24.

Figure 10:
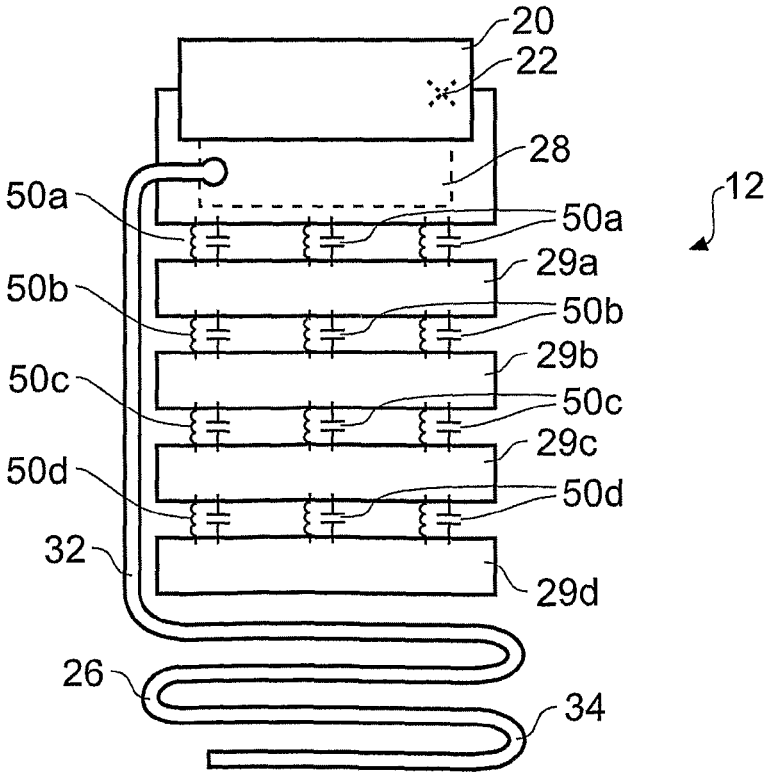
FIG. 10 illustrates an antenna arrangement according to a ninth embodiment of the invention.

FIG. 10 illustrates an embodiment in which the ground plane 24 comprises a first portion 28, a second portion 29A, a third portion 29B, a fourth portion 29C and a fifth portion 29D. The first portion 28 is separated from the second portion 29A by a first set of LC circuits 50A. The second portion 29A is separated from the third portion 29B by a second set of LC circuits 50B, the third portion 29B is separated from the fourth portion 29C by a fourth set of LC circuits 50C and the fourth portion 29C is separated from the fifth portion 29D by a fourth set of LC circuits 50D. The first set of LC circuits 50A act to electrically isolate the first portion 28 from the second portion 29A at the first resonant frequency f. The second, third and fourth sets of LC circuits 50B, 50C and 50D isolate the third portion 29B from the second portion 29A, the fourth portion 29C from the third portion 29B and the fifth portion 29D from the fourth portion 29C respectively. This ensures that all portions of the ground plane 24 are isolated form the first portion 28 at the first resonant frequency f and also reduces the coupling effects between the portions of the ground plane 24 and the grounded conductive structure 26.

Although embodiments of the present invention have been described in the preceding paragraphs with reference to various examples, it should be appreciated that modifications to the examples given can be made without departing from the scope of the invention as claimed. For example, in the embodiments illustrated the grounded conductive structure comprises a meandering portion configured to give the grounded conductive structure the ideal electrical length. It is to be appreciated that any one of a number of different configurations could be used for the grounded conductive structure including for example a helical structure.

Also, in the embodiments illustrated the first portion of the ground plane is in the same plane as the second portion of the ground plane. In other embodiments the two portions may be in different planes.

In some embodiments of the invention the first portion 28 of the ground plane 24 and the second portion 29 of the ground plane 24 may be at different potentials. For example the first portion 28 may provide a local ground to the antenna 20 while a ground on the second portion 29 may provide the ground for circuitry mounted on the second portion 29 and the voltage level of the two grounds may be different. The difference in the voltage levels may be generated by a dc-dc converter.

In embodiments in which the two portions of the ground pane 24 are at different voltages signals between the two portions may be transferred in a manner such that the signal is not affected by the difference in the potential. For example the signals may be transferred using differential signaling or optical signaling.

Features described in the preceding description may be used in combinations other than the combinations explicitly described. For example, the ground planes illustrated in FIGS. 3 to 5 may be used in combination with the grounded conductive structures of FIGS. 6 and 7.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

We claim:

1. An antenna arrangement comprising:

an antenna comprising a feed;

a ground plane coupled to the antenna comprising a first region and a second region; and a grounded conductive structure coupled to the first region of the ground plane, wherein the second region of the ground plane is configured such that at a first resonant frequency f and a corresponding resonant wavelength λ, the current flows predominantly in the grounded conductive structure compared to the second region of the ground plane; and wherein the grounded conductive structure comprises a variable tuning device configured to tune the electrical length of the grounded conductive structure so that the grounded conductive structure is resonant at a frequency other than the first resonant frequency f.

2. An antenna arrangement as claimed in claim 1 wherein the grounded conductive structure is configured so that a resonating portion comprising, the antenna, the first region of the ground plane and the grounded conductive structure has an electrical length of $$\frac{n\lambda}{m}$$

where n and m are integers.

3. An antenna arrangement as claimed in claim 2 wherein m is 2.

4. An antenna arrangement as claimed in claim 2 wherein the grounded conductive structure comprises a conductive strip configured so that the structure comprising the first region of the ground plane and the conductive strip have an electrical length of $$\frac{n\lambda}{m}.$$

5. An antenna arrangement as claimed in claim 1 wherein the grounded conductive structure is coupled to the first region of the ground plane close to the connection between the antenna and the ground plane.

6. An antenna arrangement as claimed in claim 1 wherein the second region of the ground plane comprises a structure configured so that the impedance of the second region of ground plane at the first resonant frequency f is significantly different to the impedance of the grounded conductive structure.

7. An antenna arrangement as claimed in claim 6 wherein the structure is configured to increase the impedance of the second region of ground plane at the first resonant frequency f.

8. An antenna arrangement as claimed in claim 6 wherein the structure comprises slots within the ground plane.

9. An antenna arrangement as claimed in claim 6 wherein the structure comprises a tuning circuit.

10. An antenna arrangement as claimed in claim 6 wherein the structure comprises a wave trap.

11. An antenna arrangement as claimed in claim 1 wherein the grounded conductive structure comprises a connection to another component of an apparatus within which the antenna arrangement is housed.

12. An antenna arrangement as claimed in claim 1 wherein the ground plane comprises a printed wiring board.

13. An apparatus comprising an antenna arrangement as claimed in claim 1.

14. An antenna arrangement as claimed in claim 1, wherein the tuning device is configured to enable the grounded conductive structure to be disconnected from the antenna arrangement.

15. An antenna arrangement comprising:

an antenna comprising a feed;

a ground plane coupled to the antenna comprising a first region and a second region; and a grounded conductive structure coupled to the first region of the ground plane, wherein the second region of the ground plane is configured such that at a first resonant frequency f and a corresponding resonant wavelength λ the antenna couples predominantly to the grounded conductive structure; and wherein the grounded conductive structure comprises a variable tuning device configured to tune the electrical length of the grounded conductive structure so that the grounded conductive structure is resonant at a frequency other than the first resonant frequency f.

16. An antenna arrangement as claimed in claim 15 wherein the grounded conductive structure is configured so that a resonating portion comprising, the antenna, the first region of the ground plane and the grounded conductive structure has an electrical length of $$\frac{n\lambda}{m}$$

where n and m are integers.

17. An antenna arrangement as claimed in claim 16 wherein m is 2.

18. A method comprising;

providing an antenna arrangement operable at a first resonant frequency f having a corresponding resonant wavelength, the antenna arrangement comprising: an antenna comprising a feed; a ground plane comprising a first region and a second region coupled to the antenna; and a grounded conductive structure coupled to the first region of the ground plane, the grounded conductive structure comprising a variable tuning device configured to tune the electrical length of the grounded conductive structure so that the grounded conductive structure is resonant at a frequency other than the first resonant frequency f;

receiving, by the antenna arrangement, a signal at the first resonant frequency f and coupling the antenna predominantly to the grounded conductive structure.

19. A method as claimed in claim 18 comprising configuring the grounded conductive structure so that a resonating portion comprising, the antenna, the first region of the ground plane and the grounded conductive structure have an electrical length of $$\frac{n\lambda}{m}$$

where n and m are integers.

* * * * *

UNITED STATES PATENT AND TRADEMARK OFFICE

CERTIFICATE OF CORRECTION

PATENT NO. : 8,378,900 B2
APPLICATION NO. : 12/669329
DATED : February 19, 2013
INVENTOR(S) : Hyvönen et al.

It is certified that error appears in the above-identified patent and that said Letters Patent is hereby corrected as shown below:

In the Specification:

Column 4,
Line 17, "19801" should read --1980I--.

Signed and Sealed this
Tenth Day of September, 2013

Teresa Stanek Rea
*Acting Director of the United States Patent and Trademark Office*

UNITED STATES PATENT AND TRADEMARK OFFICE

CERTIFICATE OF CORRECTION

PATENT NO. : 8,378,900 B2
APPLICATION NO. : 12/669329
DATED : February 19, 2013
INVENTOR(S) : Hyvönen et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 469 days.

Signed and Sealed this
First Day of September, 2015

Michelle K. Lee

Michelle K. Lee
*Director of the United States Patent and Trademark Office*